United States Patent [19]

Schug

[11] Patent Number: 4,959,587

[45] Date of Patent: Sep. 25, 1990

[54] ARC TUBE ASSEMBLY

[75] Inventor: Stanley M. Schug, Monroeville, Ohio

[73] Assignee: Venture Lighting International, Inc., Oakwood Village, Ohio

[21] Appl. No.: 296,772

[22] Filed: Jan. 13, 1989

[51] Int. Cl.[5] ..... H01J 9/18; H01J 9/32; H01J 61/36

[52] U.S. Cl. ..... 313/623; 313/625; 313/634; 65/59.2; 445/22; 445/43; 445/44; 445/49

[58] Field of Search ..... 313/623, 625, 634; 65/36, 59.1, 59.2, 59.25; 445/43, 22, 44, 35, 46, 49

[56] References Cited

U.S. PATENT DOCUMENTS 3,278,778 10/1966 Retzer ..... 313/623 X

*Primary Examiner*—Kenneth Wieder

*Attorney, Agent, or Firm*—Rogers & Killeen

[57] ABSTRACT

The present invention relates to an improved arc tube assembly for a high intensity metal halide lamp. The invention provides improved sealing structure for the electrode assembly using a foil to glass seal.

37 Claims, 4 Drawing Sheets

FIG. 13
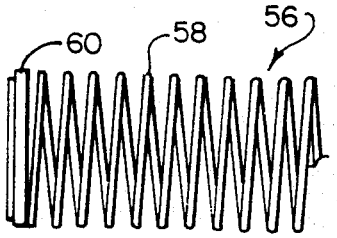
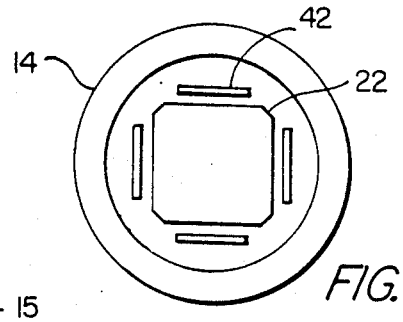
FIG. 15
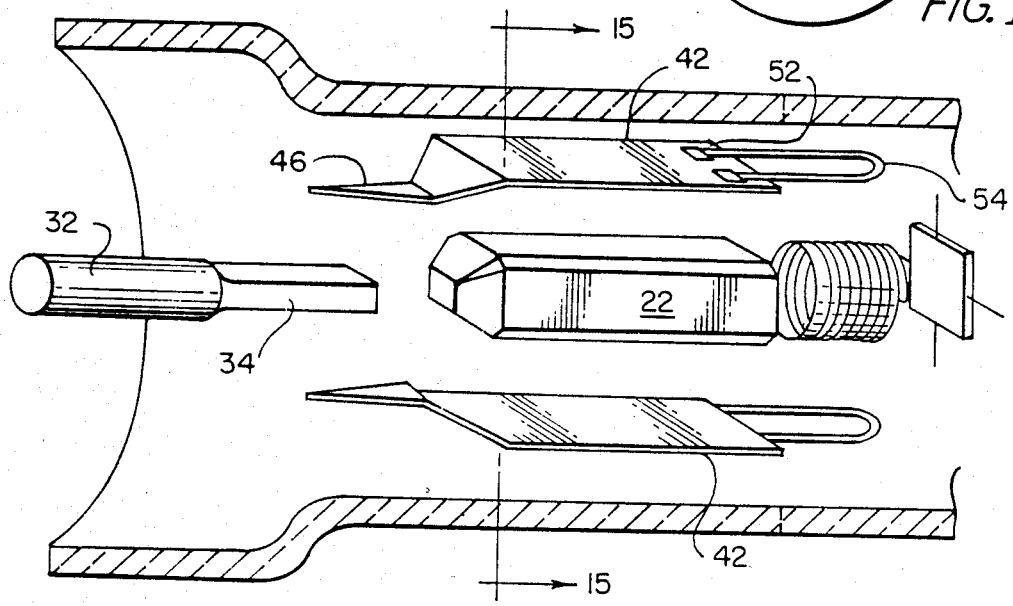
FIG. 14
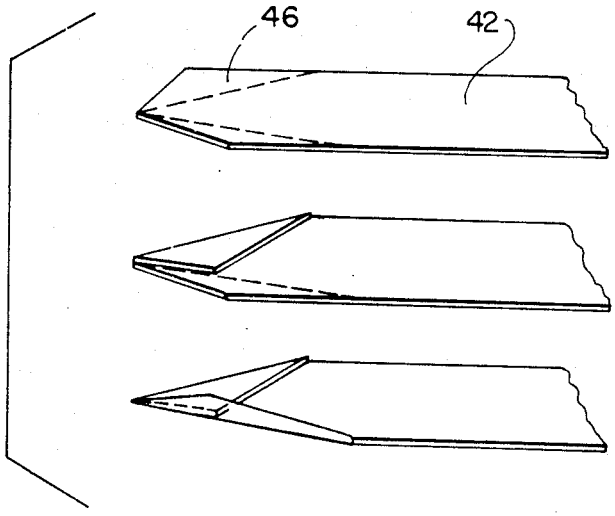
FIG. 16

ARC TUBE ASSEMBLY

BACKGROUND OF THE INVENTION

The invention relates in general to an arc tube assembly for a high intensity metal halide lamp and, particularly, to such an assembly having improved structural and mechanical integrity. More particularly, the invention relates to an arc tube assembly for a metal halide lamp which consists of a glass arc discharge envelope and a pair of side arms attached thereto, each arm containing a specially constructed electrode assembly.

High pressure mercury vapor discharge lamps are well known in the prior art. See for example, U.S. Pat. No. 3,654,506 issued to Kuehl, et al. Other prior art is shown in U.S. Pat. Nos. 4,559,472, 4,376,906, 3,868,528, 3,753,026, 4,219,757, 4,423,353, 4,254,356, 3,205,395, and 3,351,803. These patents all relate to gas discharge lamps and various components thereof. High pressure discharge lamps typically include elongated electrodes extending into a gas discharge space formed by a glass enclosure. The discharge space includes a rare gas and the electrodes form respectively a cathode and an anode, as is well understood by those skilled in the art. The electrodes lead outwardly from the glass enclosure and must be sealed hermetically thereto.

In typical high intensity metal halide lamps, a vitreous quartz arc tube discharge envelope is filled with argon gas, mercury, plus other metal salts. Protruding into the arc tube discharge envelope are two tungsten electrodes, each of which form a part of an electrode assembly. Each electrode is connected to molybdenum foil which is, in turn, connected to a follower rod, which serves as an electrical termination. The tungsten electrode assemblies including the molybdenum foil are generally, but not always, concentric with the axis of the arc tube discharge and located at opposite extremes of the arc tube discharge envelope. Each tungsten electrode assembly, including the molybdenum foil is encased in a vitreous quartz tube.

While within the sealed arc tube discharge envelope, high electrical currents are conducted to the discharge envelope through the follower rod and molybdenum foil conductors. In addition to providing the means for conducting electrical excitation to the arc tube discharge envelope, the quartz arms containing the molybdenum foil attached to the tungsten electrodes also provide the mechanical support for the arc tube discharge envelope.

It has been found that lamps of this high intensity type often fail if the seal between the vitreous quartz of each arm and the molybdenum foil conductor contained therein is not absolutely perfect. That is, in the manufacture of such lamps, intimate contact between the molybdenum foil and the vitreous quartz tubular arm must be assured. If a gap or space exists between the molybdenum foil and the vitreous quartz, a high probability exists that a crack will be formed within the vitreous quartz as a consequence of the high currents flowing within the molybdenum foil, thus causing ultimate failure of the lamps.

Manufacturing processes and structures have been suggested in the prior art to achieve a molybdenum ribbon/vitreous quartz high integrity seal. One commonly used sealing method is the pinch or press seal. In the pinch or press operation the electrode ribbon assembly is supported within a thin wall quartz tube. A two-part ring burner heats the quartz tubing to soften it, and a pair of opposing pinch jaws strike the soft quartz tubing and seal it firmly to the ribbon, leaving one end of the ribbon exposed to the air outside the seal. A pinch seal has little mechanical strength and cannot be used to support the relatively heavy discharge envelope, particularly when lamps of large size are being made.

To make a molybdenum ribbon seal air compatible, i.e., to prevent oxidation of the molybdenum ribbon, it is necessary to make it long enough to ensure that the end exposed to air is operating at a temperature low enough to preclude oxidation of the molybdenum quartz interface, or to provide a second seal which prevents the oxidizing atmosphere from reaching the seal.

These problems are addressed, e.g., in Buchwald U.S. Pat. No. 3,205,395 dated Sept. 7, 1965, which teaches the construction of a high intensity lamp by using a quartz stem pressed tube incorporating a second seal to prevent oxidation of the molybdenum ribbon seal. Moreover, Buchwald teaches the insertion of the quartz stem pressed into a vitreous quartz tube arm of slightly larger inside diameter than the outside dimension of the stem pressed tube. This built-up assembly provides the mechanical structure which constitutes the arm attached to the discharge envelope. A gap thus results between the quartz of the stem pressed tube and the exterior quartz arm. This discontinuity in quartz is not beneficial to the performance of the lamp, reducing the structural integrity of the arm while not providing the heat dissipation needed for high current operation.

In an attempt to form an improved seal between the molybdenum foil and the vitreous quartz, vacuum shrinking of the quartz arm onto the molybdenum foil electrode assembly has been attempted. Typically, an electrode assembly consisting of the tungsten electrode attached to the molybdenum foil in turn attached to the electrical terminator is inserted within a relatively thick-walled vitreous quartz tube. Using techniques known in the art, the vitreous quartz tube is vacuum shrunk about the molybdenum foil electrode assembly upon application of suitable heat. This improvement over the stem pressed structure can be made long enough to cause the exposed end to operate below the oxidation temperature of the molybdenum ribbon, thereby eliminating the necessity of a second seal. However, it has several practical drawbacks.

To achieve the strength necessary to support the discharge envelope the thickness of the vitreous quartz which must be shrunk onto the molybdenum foil is on the order of three millimeters. It is extremely difficult to heat such a thick-walled cylinder uniformly due to slight variations in the wall of the quartz tube. Because of the poor heat conducting properties of quartz, a large temperature gradient appears between the outside surface of the tube where heat is applied and the inside surface where the seal is to be made. A temperature substantially in excess of the softening point is needed at the inside wall to ensure that the quartz flows uniformly onto the ribbon and into all voids. To achieve this flow on the inside surface requires that the outside surface be molten and extremely free flowing. The heating and vacuum shrinking of such thick-walled vitreous quartz about the molybdenum foil is extremely delicate, and it has been performed in practice only by skilled artisans through manual operation. Due to the delicacy of the operation, it has not been possible to automate it with any degree of success.

A further problem in sealing heavy side arms is the residual strain left in the quartz subsequent to the sealing. Although annealing removes a good portion of the strain, subsequent thermal cycling in the operation of the lamp can introduce new strains in the side arms. These strains can build to the point of causing a crack in the side arm which invariably destroys the integrity of the seal and causes the lamp to fail. Even utilizing handmade techniques which are extremely expensive, high intensity lamps of the type manufactured by heat and vacuum shrinking thick-walled quartz about the molybdenum foil often fail due to molybdenum foil vitreous quartz seal defects.

Another attempt to solve the problem of unsatisfactory foil to glass seals is the use of an electrode assembly having two molybdenum foils separated by a thin quartz plate sealed in a lamp arm. This configuration increases the current carrying capacity of the electrode assembly in the arm; however, it is nonsymmetrical, thereby causing strain in the arm/foil assembly when the lamp thermally cycles in the operation of the lamp.

A further attempt involves the use of an electrode assembly having up to three molybdenum foils sealed in a lamp arm. Such assemblies use a quartz tube for the inner surface and a larger quartz tube for the lamp arm, and vacuum shrink seal the three foils between the two tubes. This system, however, causes cracks to occur in the foil at the transition at the electrode to foil area, so that mechanical strength and current carrying capacity are limited.

Attempts have also been made to use a prebeaded electrode assembly. Such prebead assemblies entail an extra labor and material step that renders the assembly uneconomical.

The present invention is an improved arc tube assembly for a high intensity metal halide lamp assembly consisting of a glass arc discharge envelope and a pair of side arms attached thereto, each of which side arms contain an electrode assembly of a unique and novel design sealed hermetically therein. The novel electrode assembly allows an arc tube assembly to be made having substantially greater structural and mechanical integrity as compared to the assemblies of the prior art.

It is an object of this invention to provide an improved arc tube assembly for use in connection with a high intensity metal halide lamp.

It is a further object of this invention to provide an improved arc tube assembly which includes 4 molybdenum foils hermetically sealed in the arm of a glass arc discharge envelope.

It is a further object of this invention to provide a method of making the improved arc tube assembly of this invention.

It is a further object of this invention to provide a method of making a foil to glass seal for use in an arc tube assembly.

It is a further object of this invention to provide an improved arc tube assembly which has substantially greater structural and mechanical integrity as compared to the assemblies of the prior art.

It is a further object of this invention to provide a means for connecting molybdenum foil to electrodes and electrical leads.

It is a further object of this invention to provide a means for placing molybdenum foil used in electrode assemblies under tension while undergoing shrink sealing.

It is a further object of this invention to provide a new and improved electrode assembly for use in connection with an arc tube assembly forming a part of a high intensity metal halide lamp.

The improved arc tube assembly of this invention comprises a vitreous quartz arc tube discharge envelope assembly having a pair of tubular side arms forming a part thereof and a pair of "electrode-foil-slug-outer lead" assemblies (hereinafter referred to as "electrode assembly") mounted therein. The discharge assembly comprises a gas discharge envelope to which are attached a pair of side arm tubes with capillaries. The gas discharge envelope can be tubular or globular in shape while the arms are generally tubular in shape and coaxial with one another with the side arms located on opposite sides of the discharge envelope and integrally fused to the discharge envelope. Each side arm is adapted to receive one electrode assembly of this invention into it.

The term "capillaries" is known to those skilled in the art and refers to a reduced inner dimension section of the side arm tubes at their juncture with the discharge envelope through which electrodes protrude, the outer dimensions of each electrode corresponding to the inner dimension of each capillary such that a mating relationship is achieved when the electrode projects therethrough.

Each electrode assembly is constructed from an electrode, four foil ribbon assemblies, each of which is attached to the electrode, a quartz slug forming a core for the assembly which the ribbon assemblies overlie, and four outer leads attached to the foil ribbon assemblies, all of which is intimately sealed into a side arm in the finished arc tube assembly of this invention.

The foil ribbon assembly is constructed from individual molybdenum foil ribbons specially cut and folded at one end, being connected to the electrode by a platinum weld, while on the other end is attached an outer lead (electrical terminator) by means of a platinized molybdenum interface. Each of the outer leads (electrical terminators) is constructed from molybdenum wire cut to length and formed to the desired shape. The quartz slug is constructed from a quartz rod using special fixtures and standard quartz shaping techniques to obtain the desired shape. It is then fire glazed.

In the manufacture of the arc tube assembly of this invention the arc discharge envelope with side arms attached is placed into an automated sealing machine. One electrode assembly is inserted into a side arm with the electrode projecting through the capillary section of the arm into the discharge envelope. At this point, the first arm is automatically vacuum shrink sealed to the electrode assembly. Next the second electrode assembly is inserted into the second arm in the same manner as the first. At this point the second arm is automatically vacuum shrink sealed to the second electrode assembly. Since the quartz can move very little in this configuration, there is an excellent quartz to multiple foil seal that can now be automated which is heretofore unknown in prior art.

Other objects and advantages of the present invention will be apparent to those skilled in the art from the claims and, with reference to the drawings, the following description of a preferred embodiment.

DESCRIPTION OF THE DRAWINGS

FIG. 13 is a side view of the retaining spring used in positioning the electrode assembly in place in the arc tube assembly of this invention.

FIG. 14 is an exploded view of the electrode assembly of this invention positioned in the arc tube assembly of this invention, illustrating spring means for placing molybdenum foil under tension.

FIG. 15 is a cross-sectional view through line 15 of FIG. 14.

FIG. 16 illustrates the folding of the forward end of the molybdenum foil used in the electrode assemblies of this invention, to form a pointed end.

DESCRIPTION OF THE PREFERRED EMBODIMENT

Figure 1:
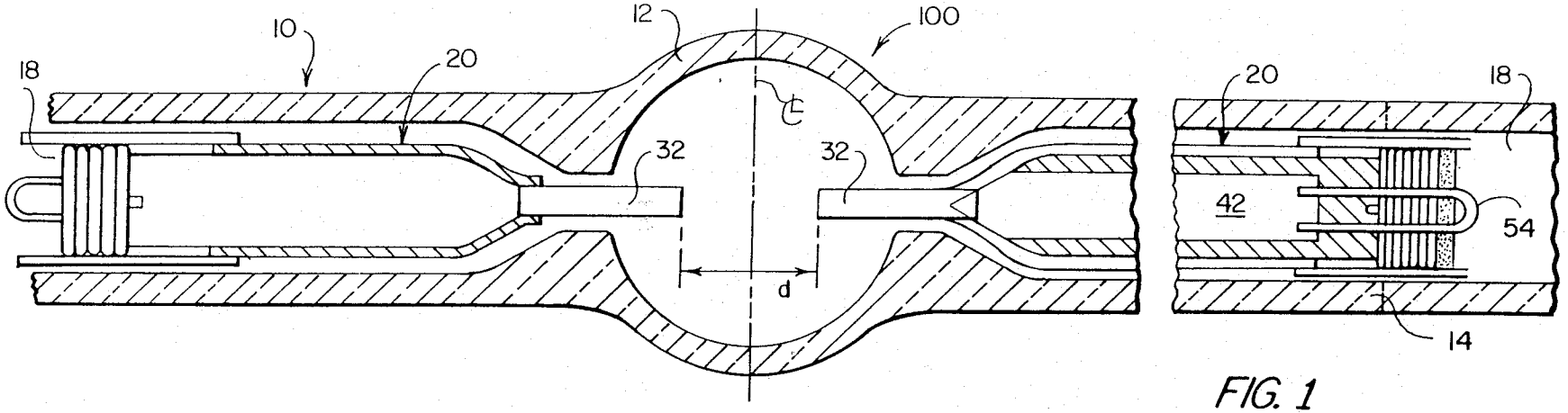
FIG. 1 is a cross-sectional view along the longitudinal axis of one embodiment of the arc tube assemblY of the present invention.
Figure 2:
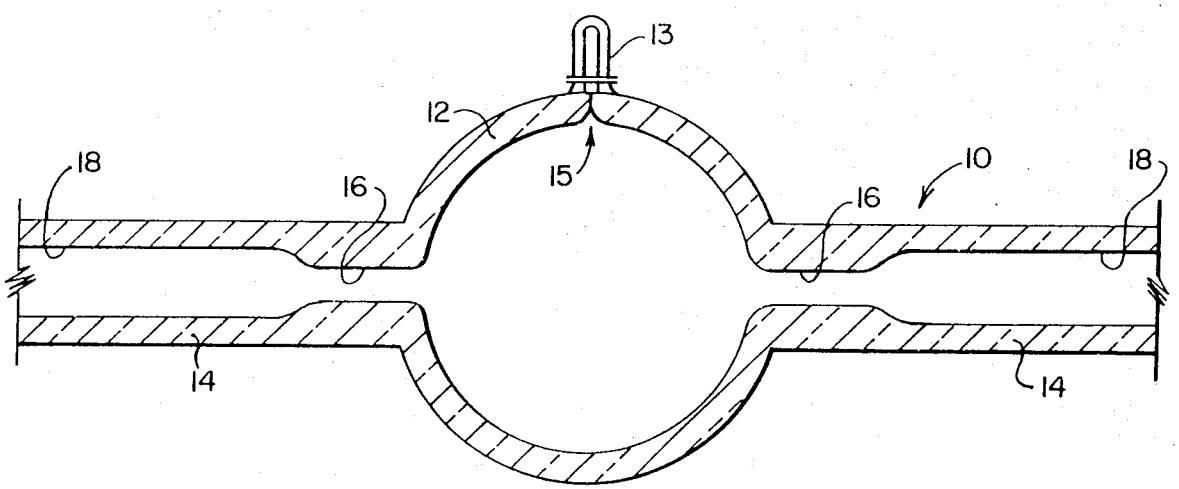
FIG. 2 is a cross-sectional view along the longitudinal axis of the arc tube discharge envelope assembly of the arc tube assembly of FIG. 1.
Figure 3:
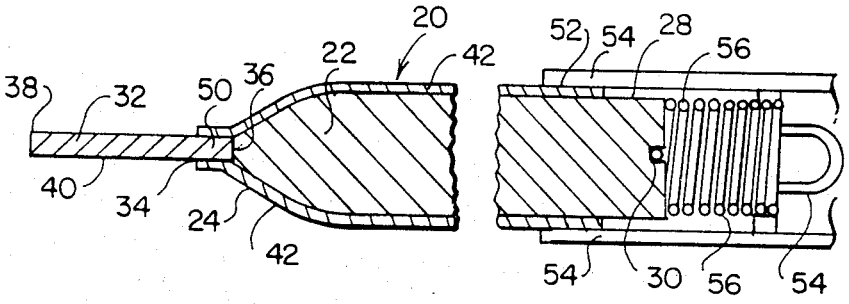
FIG. 3 is a cross-sectional view along the longitudinal axis of an electrode assembly illustrating means for placing tension on foils as the electrode assembly is shrink sealed in place.
Figure 4:
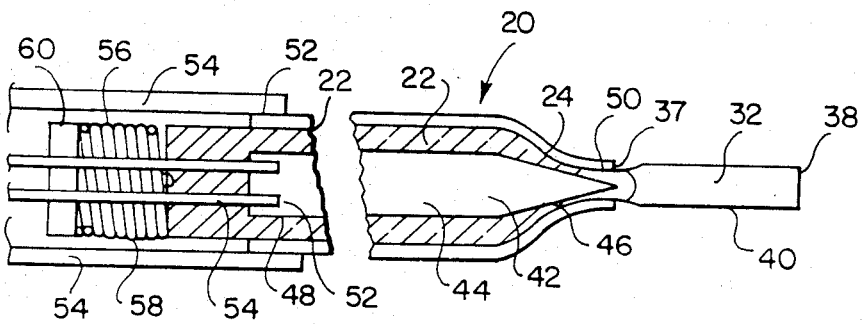
FIG. 4 is a front surface view along the longitudinal axis of an electrode assembly.
Figure 5:
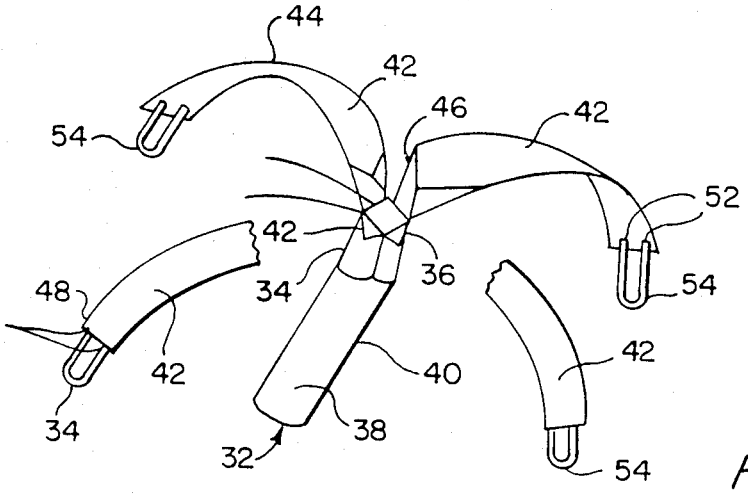
FIG. 5 is an isometric view of a portion of the electrode assembly with two of the foils cut away for clarity.

The high intensity arc tube assembly of this invention is shown by the general reference character 100 (FIG. 1). This assembly 100 comprises an arc tube discharge envelope assembly 10 (FIG. 2) consisting of a globular arc tube discharge envelope 12 to which is attached a pair of opposed side arms 14, the arms being coaxial with the envelope 12. Attached to the top of the arc tube 12 is a tubulation arm 13 in communication with the interior of the arc tube 12 through portal 15 (see FIG. 2.) Each of the arms 14 is tubular and in internal communication with the arc tube discharge envelope 12 by means of a reduced diameter capillary section 16.

Each arm 14 has an open terminal end 18 through which the electrode assembly 20 of this invention is inserted.

Figure 6:
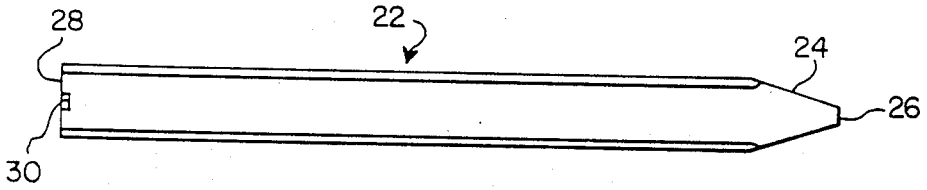
FIG. 6 is a side view of the quartz slug forming a part of the electrode assembly of this invention.
Figure 7:
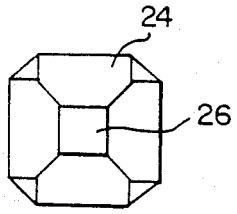
FIG. 7 is a front view of the quartz slug shown in FIG. 6.

Referring to FIGS. 1,3,4, and 5 in particular, each electrode assembly 20, one of which is positioned in each side arm and hermetically sealed therein in the finished product, comprises a four sided quartz slug 22 (FIGS. 6 and 7) having a tapered forward end 24, terminating in a flat face 26 square in cross section having a cross-sectional dimension less than the body of the slug, and a flat rearward end 28, the rearward end 28 having a transverse groove 30 therein. Preferably, the four edges of the four sided quartz slug 22 are beveled at the intersections of the various sides, in order to facilitate ease of insertion of the electrode assembly 20 in each of the side arms 14.

Figure 11:
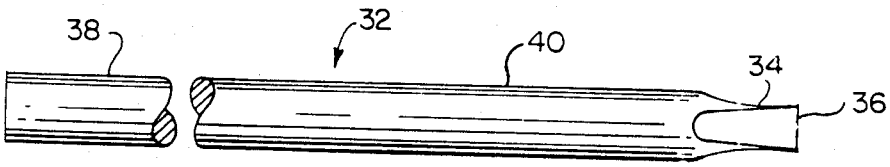
FIG. 11 is a side view of the electrode forming a part of the electrode assembly of this invention.
Figure 12:
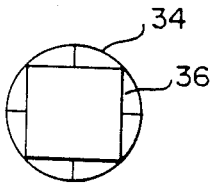
FIG. 12 is a rear view of the electrode shown in FIG. 11.

An electrode 32 (FIGS. 11 and 12) is positioned at the forward end 24 of each slug 22 on the same longitudinal axis thereof, and abuts therewith. Each electrode 32 is cylindrical in shape, and has a rearward section 34 tapered inward to form a flat face 36 square in cross section, a forward nose 38, and a body section 40.

Figure 8:
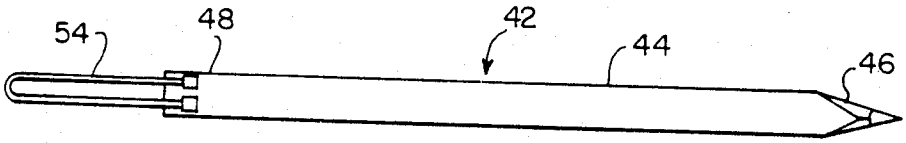
FIG. 8 is a top view of a single molybdenum foil to which is attached an electrical lead, both forming a part of the electrode assembly of this invention.

A piece of molybdenum foil 42 (FIG. 8) overlies each side of the quartz slug. Each foil 42 is identical and has a body 44 with a tapered front end 46 and a squared off rear end 48.

The body 44 of the foil 42 is an elongated rectangle. The tapered front end of the foil 42 projects beyond the slug 22 onto the rear of the electrode 32, and is attached thereto by means of a platinum tab 50. Preferably, the width of the foil at the point it overlies the electrode 32 is the same as the width of one side of face 36 of electrode 32. This ensures maximum electrical conductance from the electrode 32 to each foil 42.

Figure 10:
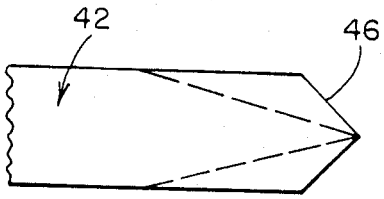
FIG. 10 is an enlarged view of the front end of the foil of FIG. 8 showing its prefolded configuration.

In a preferred embodiment, the tapered front end 46 of the foil has the configuration shown in FIG. 10 before being folded. The tip is folded along the dotted lines to form a sharp triangular shaped point (see FIG. 16), then overlapped onto the electrode 36 and fastened with the platinum weld 50. The amount of overlap is such that the width of the foil, including the folded portion, is equal to the width of one side of the square on the face 36 of the electrode.

Figure 9:
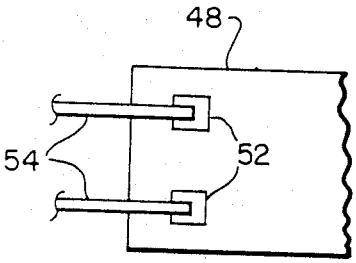
FIG. 9 is an enlarged view of a portion of the molybdenum foil shown in FIG. 8, the electrical lead connected to the rear of said molybdenum foil, and the platinized tabs acting as an interface between the electrical lead and the molybdenum foil and serving as means of attachment therefor.

Preferably the foil 42 has a maximum width of less than about 60 to 75% of the side of quartz slug 22 which it overlies. The surface of the rear end 48 of each foil 42 has platinized molybdenum tabs 52 mounted thereon (FIG. 9), to which is attached an electrical lead 54. Each electrical lead 54 may be U-shaped and extends rearward from its point of attachment on the foil 42.

In the process of manufacture of the arc tube assembly of this invention, a retainer spring 56 is used to place tension on each of the foils 42.

The retainer spring 56 comprising wound molybdenum wire 58, abuts the rearward end 28 of each slug 22, aligned on the same horizontal axis as the slug. The spring 56 (FIG. 13) is affixed to the slug 22 by the forward end of the spring being seated in the transverse groove 30 of the slug 22.

A thin nickel strip 60 (FIGS. 3, 4, and 13) is placed around the rear coil of the spring 56 and is fixed thereto.

Each of the electrical leads 54 is attached to the outer surface of the nickel strip 60.

Prior to attaching the outer leads 54 to the nickel strip 60, the spring 56 is placed under compression. Thus, when the compressive force on the spring 56 is released the tension created on each of the leads 54 draws each of the molybdenum foils 42 taut against the respective sides of the quartz slug 22.

This enables maximum current carrying capacity through each foil 42 to be obtained.

In the manufacture of the improved lamp of this invention, an arc tube discharge envelope assembly 10 is obtained, and the electrode assemblies 20 are put in place, one in each arm 14. The forward nose 38 of each electrode 32 projects through the capillary section 16 of each arm 14 and terminates within the arc discharge envelope 12.

Referring to FIG. 1, once assembled, the distance "d" between the end of each tungsten electrode 32 must be set. The distance "d" significantly affects the operating characteristics of high intensity metal halide lamps. For example, for a 12,000 watt high intensity metal halide lamp the distance between the ends of the electrodes 32 is approximately 30.00 millimeters ± 1.00 millimeters. Maintaining the tolerance of such electrode spacing is difficult in prior art metal halide lamps because of the distance the softened quartz must travel to contact the electrode and the time that it takes for the quartz to make contact to hold the parts in place while finishing the seal.

With the present invention each electrode assembly 20 is rigid, and it is a simple matter to exert force on the end of each electrode assembly 20 so as to position each of the noses 38 into the proper distance "d" relationship. When sealing is done the quartz slug is in contact radially at the four round corners so that distance "d" can be easily maintained during the shrink sealing operation.

In manufacturing the arc tube assembly 100, the terminal ends 18 of side arms 14 are inserted into an automatic shrink sealing machine. Thereafter it is possible to shrink seal the arms by introducing a vacuum in the leg and appropriately applying heat to the side arms 14, which in turn heat each electrode assembly 20. After the side arm is shrunk around the electrode assembly, and cooled, thereby forming a hermetic seal between the side arms and the electrode assembly including foils, that excess of each side arm extending beyond the end of the slug is cut off (see dotted line in FIG. 1). This frees the spring for removal, leaving the leads 54 projecting outwardly and the foils 42 sealed in place under tension.

In completing the manufacture of arc tube assembly 100 it is only necessary to fill the discharge envelope assembly 10 with the desired fill material and thereafter remove tubulation arm 13 and seal the envelope at portal 15.

Electrode assemblies similar to the electrode assemblies 20 as described here may be applied to arc tube assemblies for high intensity metal halide lamps where (a) an intimate, defect-free seal between the vitreous quartz (or like material) and molybdenum ribbon foil (or like material) is required and (2) where very high current carrying capacity is required.

Practically speaking, many high intensity metal halide lamps of prior art fail due to imperfections at the vitreous quartz/molybdenum ribbon foil seal or due to thermally induced, nonsymmetrical tensile stresses which cause side arm cracking clear through the seal. Structures of the present invention avoid these problems.

Apart from the advantage of the improved structural integrity of arc tube assembly 100 the construction of the assembly 100 lends itself to automated production techniques. Prior art assemblies are known to be constructed by skilled artisans in manual operations due to the delicacy of the vitreous quartz vacuum shrinking and/or fusing operations. Due to the manual labor required to construct prior art lamps, such lamps are extremely expensive. One factor which significantly contributes to the need for highly skilled manual labor to construct such prior art lamps is the fact that heat shrinking thick-walled tubing of approximately three millimeters thickness directly onto a single molybdenum foil, or even a double molybdenum foil assembly separated by a quartz plate is extremely difficult because of the distance the quartz must move and the nonsymmetrical shape of the completed arm assembly.

In producing the arc tube assembly 100 of the present invention, it is only necessary to vacuum shrink the vitreous quartz to the slug which is only a fraction of the shrinking distance of previous art. The arm assembly 14 is also symmetrical thus permitting the realization of automated techniques in the sealing of each electrode assembly 20 and arc tube discharge envelope assembly 10. Such automated techniques significantly reduce the cost of assemblies produced in accordance with the present invention.

The metal halide lamps produced utilizing arc tube assemblies in accordance with this invention have a high current carrying capacity, a side arm that is basically symmetrical which will better radiate heat generated by the current loading of the molybdenum foil and has an improved four foil molybdenum foil/quartz seal that can be manufactured by automated techniques.

Additionally, the design of the electrode assembly forming a part of the arc tube assembly of the invention minimizes the distance the quartz must flow, thereby substantially improving the quartz to foil wetting uniformity. Still further, the arc tube assembly of this invention minimizes the number of process steps by direct shrinking of the arm tubes to the electrode assembly. Another advantage is that the base operating temperature is minimized by increasing the arm surface area so that heat can better be radiated, thus lowering the base temperature. Still further, the design of the electrode assembly used in the arc tube assembly of this invention eliminates strain in the arm due to subsequent thermal cycling caused by operation of the lamp, thereby significantly increasing the mechanical and thermal stability of the lamp.

While a specific embodiment of the present invention has been described and illustrated, it is to be understood that the present invention is defined by the claims, and that many other embodiments will be apparent to persons skilled in the art when accorded a full range of equivalents.

What is claimed is:

1. An improved arc tube assembly for a high-intensity metal halide lamp, comprising:

(a) an arc tube discharge envelope assembly including:

(1) a glass arc tube envelope forming a cavity adapted to receive a pair of electrodes therein, and (2) a pair of glass side arms with capillaries rigidly fused to said arc tube envelope on opposite sides thereof and coaxial therewith, each of the side arms being adapted to receive one electrode assembly therein; and (b) a pair of electrode assemblies positioned one each in said side arms and comprising in combination:

(1) an elongated quartz slug with beveled edges in a substantially square cross section having a forward end tapered inwardly on each side and terminating with a flat face square in cross section, and a flat rearward end substantially square in cross section with a transverse groove therein, (2) a rod shaped electrode coaxial with said slug and abutting the forward end thereof, (3) four molybdenum foils each overlying one side of said slug, each of said foils having a tapered front end projecting beyond said slug and attached to said electrode and a rear end having a tab rearwardly extending therefrom, and (4) an electrical lead attached to the tabs at the rear end of said foils, said electrode assemblies being intimately fused to said side arms with said electrodes protruding into said arc tube envelope through said capillaries with said electrical leads projecting rearwardly from said side arms.

2. The arc tube assembly of claim 1, wherein said glass is vitreous quartz.

3. The arc tube assembly of claim 1, wherein said ribbon foil conductors are constructed from molybdenum, said electrodes are constructed from tungsten and said electrical leads are constructed from molybdenum.

4. An arc tube assembly for a high intensity metal halide lamp comprising:

a generally cylindrical envelope having two coaxial side arms opposedly extending therefrom; and an electrode subassembly comprising an elongated quartz slug generally square in cross section, an electrode coaxially extending from said slug, and four molybdenum foil ribbons each overlying one side of said slug, said subassembly being disposed in each of said side arms, said envelope and said foil ribbons shrink sealed about said subassemblies.

5. The arc tube assembly as defined in claim 4 further comprising a platinum tab attached to each of said foil ribbons for connecting said foils to said electrode.

6. The arc tube assembly as defined in claim 4 further comprising a lead extending from the end of said electrode subassembly opposite said electrode, and a platinum tab attached to an end of each of said foil ribbons for connecting said foils to said lead.

7. The arc tube assembly as defined in claim 4 further comprising means for placing tension on each of said foil ribbons.

8. The arc tube assembly as defined in claim 7 wherein said means for placing tension comprises a spring.

9. The arc tube assembly as defined in claim 4 wherein each of said foil ribbons has a width less than 60–75% the side of said slug.

10. The arc tube assembly as defined in claim 4 further comprising plural leads welded to the end opposite said electrode of at least one of said foil ribbons, each of said welds being independent of the others and having substantially the same current carrying capacity.

11. The arc tube assembly as defined in claim 4 wherein the shrinking distance between the inner surface of each of said side arms and the outer surface of said electrode subassembly is form 1.3 to 0.2 millimeters.

12. The method of making a foil to glass seal comprising the steps of:

(a) providing a first and second elongated glass layer;

(b) providing an elongated metal foil lenticular in cross section with a width to maximum thickness of at least 100:1, a length of at least 25 mm, and a width less than the width of the glass layer;

(c) positioning the foil between the glass layers;

(d) tensioning the foil in the longitudinal direction thereof sufficiently to prevent wrinkles from occurring during the sealing operation;

(e) heating the glass layers in a temperature range of 1600 degrees C. to 2500 degrees C. while reducing the pressure between the glass layers relative to the pressure external of the glass layers to draw the glass layers into intimate contact with the foil along substantially the entire length thereof and to allow the softened quartz to wet to the foils on all sides of the foil and contract the edges of the glass layers to each other alongside the foil;

(f) cooling the glass layers to effect a glass to foil seal; and (g) releasing the tension on the foil.

13. The method as defined in claim 12 further comprising the step of separating the first and second glass layers by 1.35 to 0.2 millimeters before heating the glass layers.

14. A glass to foil seal comprising in cross section:

a square of glass;

a foil having a width less than 60–75% of the side of said square overlying each side of said square in sealing contact therewith; and a continuous, generally circular layer of glass overlying the combination of said square and said foils in sealing contact with all exposed surfaces.

15. In an arc tube assembly for a high intensity lamp consisting of a glass arc tube envelope forming a cavity adapted to receive a pair of electrodes therein, and a pair of glass side arms rigidly fused to said arc tube envelope each adapted to receive an electrode assembly therein, the improvement wherein said electrode assembly comprises in combination:

(a) an elongated quartz slug with beveled edges substantially square in cross section, the forward end being tapered inwardly on each side and terminating with a flat face substantially square in cross section and a rearward end terminating with a flat face;

(b) a elongated electrode coaxially abutting said slug at the forward end thereof;

(c) four molybdenum foils, one overlying each side of said quartz slug, each of said foils having a tapered front end projecting beyond said slug and onto said electrode, and being attached thereto, and a rear end having platinized molybdenum tabs rearwardly extending therefrom;

(d) an electrical lead attached to said platinized molybdenum tabs and extending rearwardly therefrom, said electrode assembly being intimately fused to said side arms with said electrodes protruding into said arc tube envelope and said electrical leads projecting rearwardly beyond said arms.

16. The arc tube assembly of claim 15 wherein each of said ribbon foil conductors in said electrode assemblies is constructed from molybdenum, said electrodes are tungsten, and said electrical leads are constructed from molybdenum.

17. The arc tube assembly of claim 15, wherein said side arms and said arc tube are coaxial.

18. In an arc tube assembly for a high-intensity metal halide lamp comprising a glass arc tube envelope, and a pair of glass side arms rigidly fused to said arc tube envelope, each of said side arms being adapted to receive an electrode assembly therein, the improvement wherein said electrode assembly comprises four molybdenum foil ribbons shrink sealed around an elongated center quartz slug having four flat sides.

19. An electrode assembly for an arc tube assembly for a high intensity metal halide lamp comprising in combination:

(a) an elongated four sided quartz slug with beveled edges having a forward end tapered inwardly on each side to terminate in a flat face substantially square in cross section and having a flat rearward end substantially square in cross section;

(b) an elongated electrode coaxially abutting the forward end of said slug;

(c) four molybdenum foils, one overlying each side of said quartz slug, each of said foils having a tapered front end projecting beyond said slug and onto said electrode, being attached thereto, and having a platinized molybdenum tab rearwardly extending therefrom; and (d) an electrical lead attached to said platinized molybdenum tabs and extending rearward therefrom.

20. The electrode assembly as defined in claim 19 further comprising means for placing tension on each of said foils.

21. The arc tube assembly as defined in claim 20 wherein said means for placing tension comprises a spring.

22. An improved arc tube assembly for a high-intensity metal halide lamp comprising in combination:

(a) an arc tube discharge envelope assembly consisting of:

(1) a glass arc tube envelope forming a cavity adapted to receive a pair of electrodes therein, and (2) a pair of glass side arms rigidly fused to said arc tube envelope and communicating internally therewith, each of said side arms being adapted to receive one electrode assembly therein, (b) a pair of electrode assemblies positioned one each in said side arms and hermetically sealed therein, each of said electrode assemblies comprising in combination:

(1) a four sided quartz slug, (2) an electrode coaxially abutting the forward end of said slug, (3) four molybdenum foils each one overlying one side of said quartz slug, (4) four electrical leads each one attached to the rearward end of one of said foils, (5) means connecting each of said foils to said electrode, (6) means connecting each of said electrical leads to the rearward end of each foil, (7) means for placing tension on each foil when said electrode assembly is positioned in said side arm, said electrode assemblies being intimately fused to said side arms with the tips of said electrodes protruding into said arc tube envelope and positioned a predetermined distance from each other on the same longitudinal axis.

23. The improved arc tube assembly of claim 22 wherein said means for connecting each of said foils to said electrode is a platinum tab attached to the forward end of each foil.

24. The improved arc tube assembly of claim 22 wherein said means for connecting said electrical leads to the rearward end of each foil is a platinum tab on the rearward end of each foil.

25. The improved arc tube assembly of claim 22 wherein said means of placing tension on each foil includes a spring under compression abutting the rearward end of said slug and a thin nickel strip around the rearward end of said spring and fixed thereto, said leads being attached to said strip on the outer periphery thereof.

26. An electrode assembly comprising:

(a) a four sided quartz slug, (b) an electrode aligned at the forward end of said slug on the same longitudinal axis, and abutting thereto, (c) four molybdenum foils each overlying one side of said quartz slug, (d) four electrical leads each attached to the rearward end of one of said foils, (e) means connecting each of said foils to said electrode, (f) means connecting each of said electrical leads to the rearward end of each foil, and (g) means of placing tension on each foil.

27. The electrode assembly of claim 26 wherein said means of placing tension on each foil is a coil spring abutting the rearward end of said slug, and a thin nickel strip attached to the rearward end of said spring, said leads being attached to said strip on the outer periphery thereof.

28. The electrode assembly as defined in claim 26 wherein each of said foils has a width less than 60–75% the side of said slug.

29. The electrode assembly as defined in claim 26 further comprising four additional electrical leads, each attached to the rearward end of one of said foils.

30. A method for the manufacture of an arc tube assembly for use in a high-intensity metal halide lamp in which said arc tube assembly comprises a glass arc tube envelope forming a cavity adapted to receive a pair of electrodes therein, a pair of coaxial glass side arms fused to said arc tube envelope on opposite sides thereof, and a pair of electrode assemblies, one each of said electrode assemblies positioned in one of said side arms with said electrodes extending into the envelope comprising the steps of:

(a) providing an elongated quartz slug having a forward end tapered inwardly on each side, a rod shaped electrode coaxially abutting the slug at the forward end thereof and a plurality of molybdenum foils, each overlying said quartz slug, each of said foils having a tapered front end projecting beyond said slug and onto said electrode, and a rear end having an electrical lead attached thereto;

(b) positioning a retainer spring assembly onto the rearward end of said slug;

(c) positioning a thin nickel strip around the rearward end of said spring and fixing it thereto;

(d) placing the spring under compression; and (e) attaching said electrical leads to said retainer spring, whereby said retainer spring under compression tensions each of the foils.

31. The method of claim 30 including the further step of hermetically sealing said electrode assembly into said glass side arms, thereby permanently sealing said glass arms to said electrode assemblies while said foils are under tension.

32. A method of sealing an electrode subassembly into the side arm of an arc tube assembly, said electrode subassembly having a quartz slug overlain with plural conductive foils, each of said foils being attached at a first end to an electrode and at a second end to a lead, the method comprising the steps of:

(a) positioning tensioning means at the rearward end of said slug adjacent said leads;

(b) engaging said leads with said tensioning means, thereby applying tension to each of said foils;

(c) positioning said electrode into said side arm;

(d) heat shrinking said side arm, while maintaining tension to each of said foils whereby said electrode subassembly is sealed into said side arm; and (e) cutting said arm and said electrode subassembly so that said tensioning means is removed from said arc tube assembly.

33. The method as defined in claim 32 wherein said tensioning means comprises a spring.

34. The method as defined in claim 33 further comprising the step of affixing a nickel strip to said leads for engaging with said spring.

35. In a electrode subassembly for an arc tube assembly, said electrode subassembly having a center quartz slug overlain with plural conductive foils, each of said foils being attached at a first end to an electrode and at a second end to a lead, the improvement comprising:

(a) tensioning means at the rearward end of said slug adjacent said lead; and (b) means attached to said lead for compressibly engaging said tensioning means so that said foils are under tension when said means for engaging compresses said tensioning means.

36. The electrode subassembly as defined in claim 35 wherein said tensioning means comprises a spring.

37. The electrode subassembly as defined in claim 36 wherein said means for engaging comprises a nickel strip.

* * * * *